US006155843A

United States Patent [19]

Tung

[11] Patent Number: 6,155,843

[45] Date of Patent: Dec. 5, 2000

[54] IC CARD CONNECTOR ASSEMBLY

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/379,757

[22] Filed: Aug. 24, 1999

[30] Foreign Application Priority Data

Dec. 31, 1998 [TW] Taiwan ..... 87222064

[51] Int. Cl.[7] ..... H01R 12/00

[52] U.S. Cl. ..... 439/64; 439/79

[58] Field of Search ..... 439/64, 101, 608, 439/79, 541.5, 74

[56] References Cited

U.S. PATENT DOCUMENTS 5,636,999 6/1997 Hirai et al. ..... 439/79

5,688,130 11/1997 Huang ..... 439/79

*Primary Examiner*—Gary F. Paumen

*Attorney, Agent, or Firm*—We Te Chung

[57] ABSTRACT

An IC card connector assembly comprises a pair of stacked header connectors and a locator. The header connectors include a plurality of terminals. Each terminal has a mounting portion downwardly extending beyond the header connector. The locator includes a pair of side walls and a center portion defining a cavity therebetween, the center portion defining two rows of tunnels and a cavity in communication with the cavity. Each tunnel forms a projecting area on an inner surface thereof proximate the cavity. The mounting portions are arranged in two rows. Each mounting portion extends through the corresponding tunnel of the locator and into the cavity. The projecting area outwardly deflects the mounting portion to closely abut against the inner surface of the side wall thereby ensuring reliable engagement with contacts of a plug mounted on a mother board.

7 Claims, 6 Drawing Sheets

IC CARD CONNECTOR ASSEMBLY

BACKGROUND OF THE INVENTION

The present invention relates to an IC card connector assembly, and especially to an IC card connector assembly having a locator for promoting reliable electrical connection between the IC card connector assembly and a plug mounted on a mother board.

An IC card connector is adapted to electrically connect an IC card to a mother board. Terminals of the IC card connector are usually connected to the mother board by one of two methods. One method involves directly soldering the terminals to the mother board. Another method is to mount the terminals in a locator, and then mate the locator with a plug mounted on the mother board. Since the connection between the locator and the plug is releasable, the IC card connector assembly can be easily accessed for repair. The related prior art is disclosed in U.S. Pat. Nos. 5,636,999 and 5,688,130.

Referring to FIG. 1, a conventional IC card connector assembly 7 comprises a pair of stacked header connectors 72 and a locator 8. Four rows of terminals 74 are disposed in the header connectors 72. Each terminal 74 includes a mounting portion 70 extending beyond the header connector 72. The mounting portions 70 are arranged in two rows and are downwardly bent to be received in the locator 8. A plug 9 mounted on a mother board 73 includes two rows of contacts 91. The locator 8 mates with the plug 9 and the mounting portions 70 of the terminals 74 engage with the corresponding contacts 91 for establishing signal transmission therethrough. The mounting portions 70 abut against inner surfaces of the locator 8 due to the elastic resilience of the mounting portions 70. However, such elastic resilience will decline after repeated engagement/disengagement between the mounting portions 70 and the contacts 91. Thus, the mounting portions 70 can not effectively contact the inner surfaces of the locator 8 and clearance may be formed therebetween. When engaging with the contacts 91, the mounting portions 70 may be inwardly deformed such that the mounting portions 70 would not touch a predetermined portion of the contacts 91 of the plug 9 thereby impeding proper engagement between the mounting portions 70 and the contacts 91 and adversely affecting signal transmission.

SUMMARY OF THE INVENTION

Accordingly, the primary object of the present invention is to provide an IC card connector assembly having a locator for promoting reliable electrical connection between the IC card connector assembly and a mating plug mounted on a mother board.

To fulfill the above-mentioned object, an IC card connector assembly comprises a pair of stacked header connectors and a locator. The header connectors include four rows of terminals. Each terminal has a mounting portion downwardly extending beyond the header connector. The locator includes a center portion and a pair of side walls. The locator defines two rows of tunnels proximate the side wall for receiving the mounting portions. A cavity in communication with the tunnels is defined by the center portion and the side walls. A projecting area is formed at the center portion and exposed to the tunnel. An inclined surface is formed between the projecting area and a top surface of the locator. The distance between the two rows of the tunnels is slightly larger than the distance between the two rows of the mounting portions. Each mounting portion extends through the corresponding tunnel of the locator and into the cavity. The projecting area biases the mounting portion toward the side wall for fixing the mounting portion thereby ensuring reliable engagement with contacts of a plug mounted on a mother board.

Other objects, advantages and novel features of the invention will become more apparent from the following detailed description when taken in conjunction with the accompanying drawings.

DETAILED DESCRIPTION OF A PREFERRED EMBODIMENT

Figure 1:
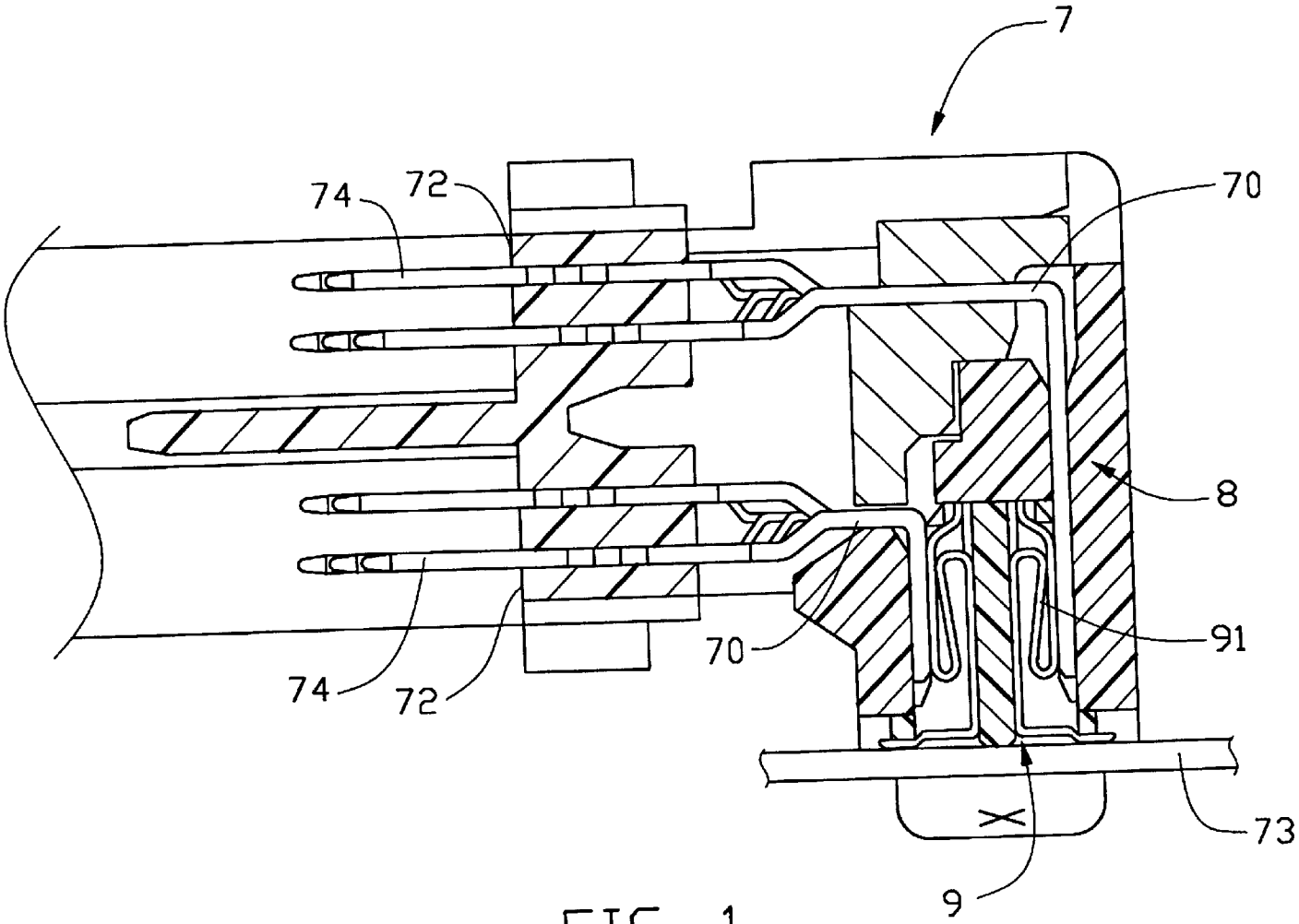
FIG. 1 (PRIOR ART)
FIG. 1 is a partial, cross-sectional view of a conventional IC card connector assembly engaging with a plug mounted on a mother board.
Figure 2:
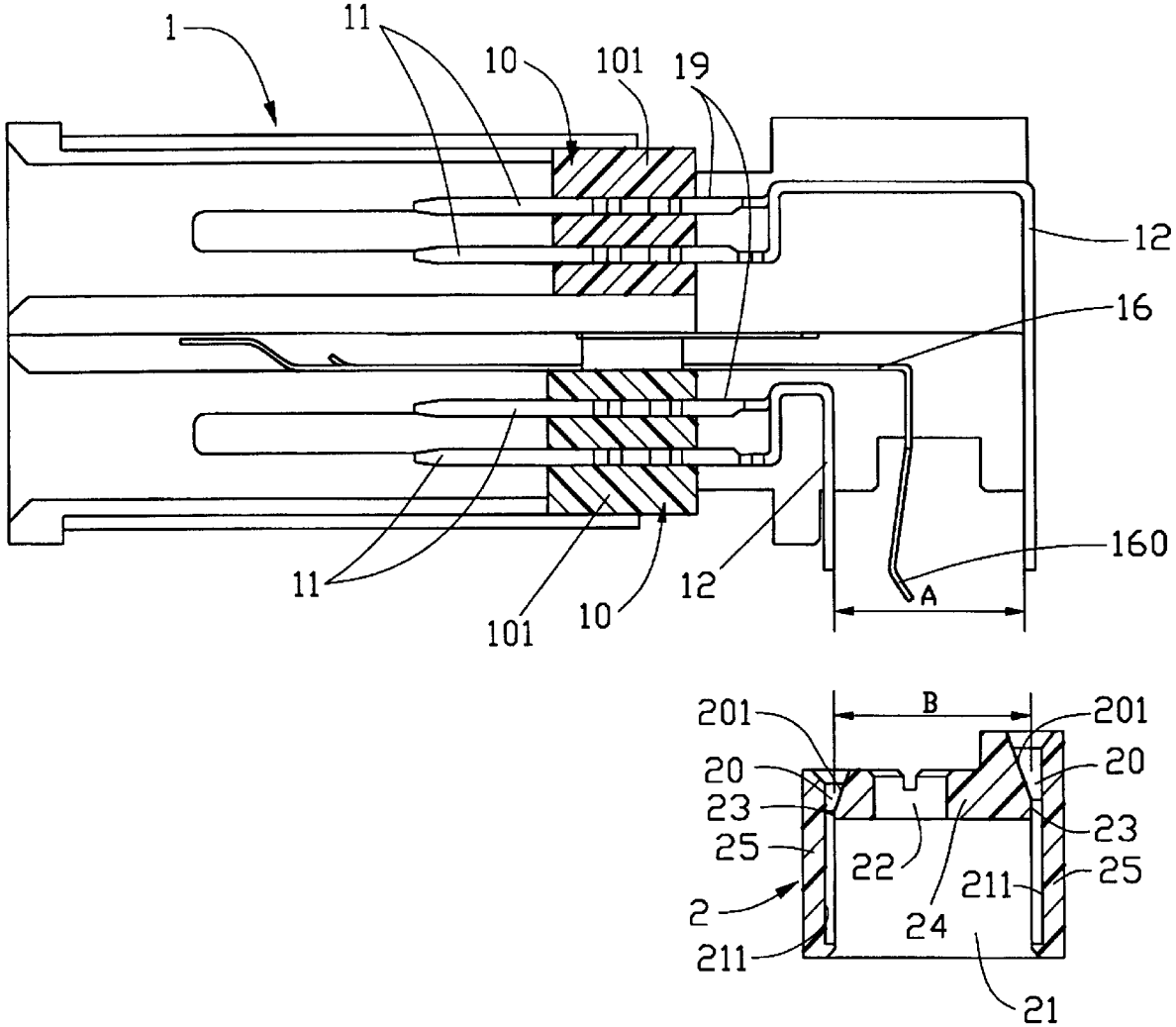
FIG. 2 is a partial, cross-sectional view of an IC card connector assembly in accordance with the present invention before terminals thereof are mounted to a locator.

Referring to FIG. 2, an IC card connector assembly I in accordance with the present invention comprises a pair of stacked header connectors 10 and an insulative elongate locator 2. Each header connector 10 includes an insulative housing 101 and two rows of terminals 19 retained in the housing 101. Each terminal 19 has a mating portion 11 extending into the header connector 10 for engaging with an inserted IC card (not shown), and a mounting portion 12 opposite the mating portion 11 and downwardly extending beyond the housing 101. The mounting portions 12 are arranged in two rows. A grounding plate 16 is disposed between the header connectors 10 and forms a plurality of fingers 160 downwardly extending between the two rows of the mounting portions 12.

The locator 2 includes a center portion 24 and a pair of side walls 25. The locator 2 defines two rows of tunnels 20 proximate the side walls 25, an opening 22 between the two rows of tunnels 20, and a cavity 21 defined by the center portion 24 and the side walls 25. The tunnels 20 and the opening 22 are in communication with the cavity 21. A distance B between the two rows of the tunnels 20 is slightly larger than a distance A between the two rows of the mounting portions 12 of the terminals 19. A projecting area 23 is formed at the center portion 24 and exposed to each tunnel 20. An inclined surface 201 is formed between each projecting area 23 and a top surface of the locator 2.

Figure 3:
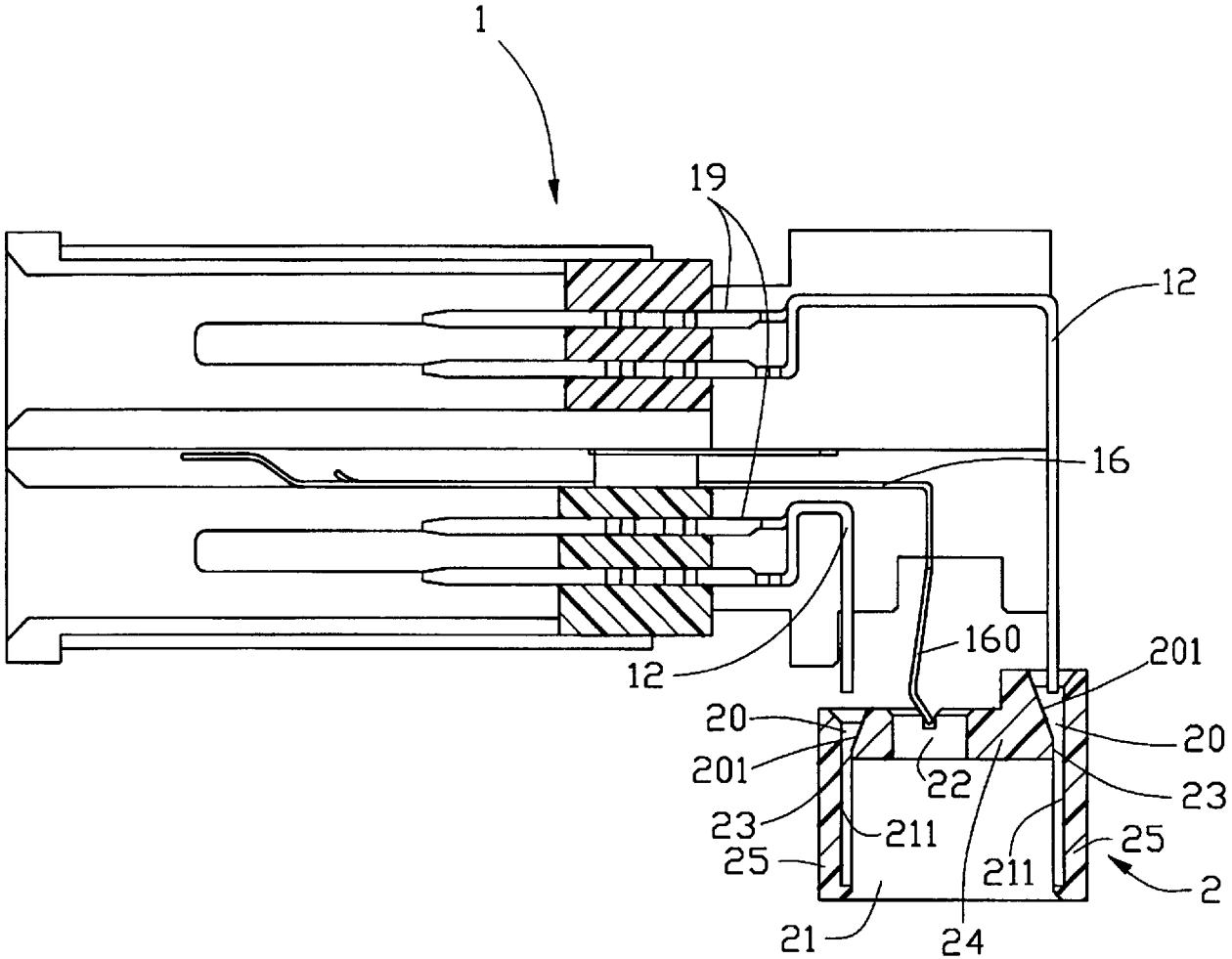
FIGS. 3, 4, and 5 are sequential views similar to FIG. 2 showing the locator being assembled to the IC card connector.
Figure 4:
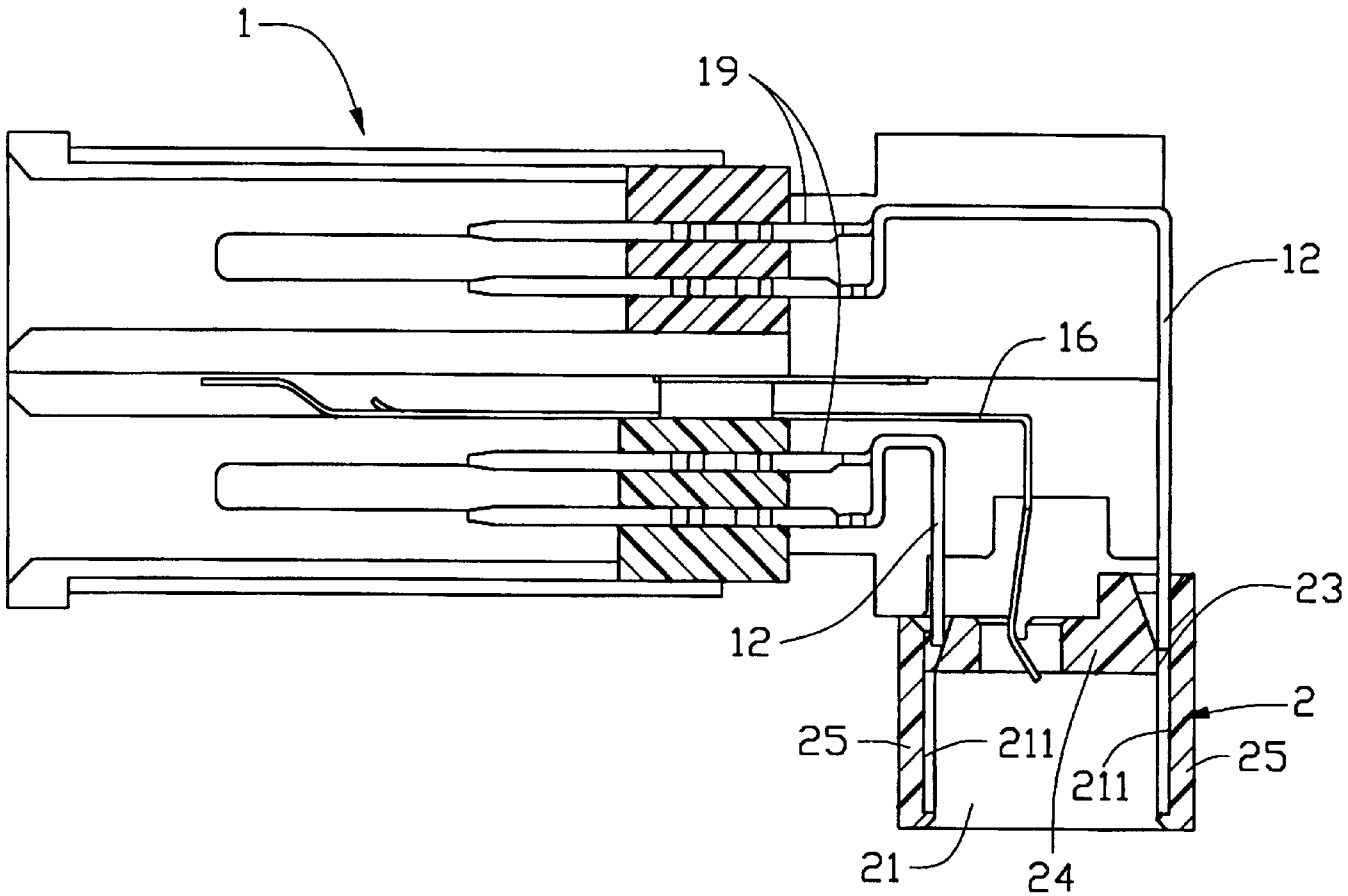
Figure 5:
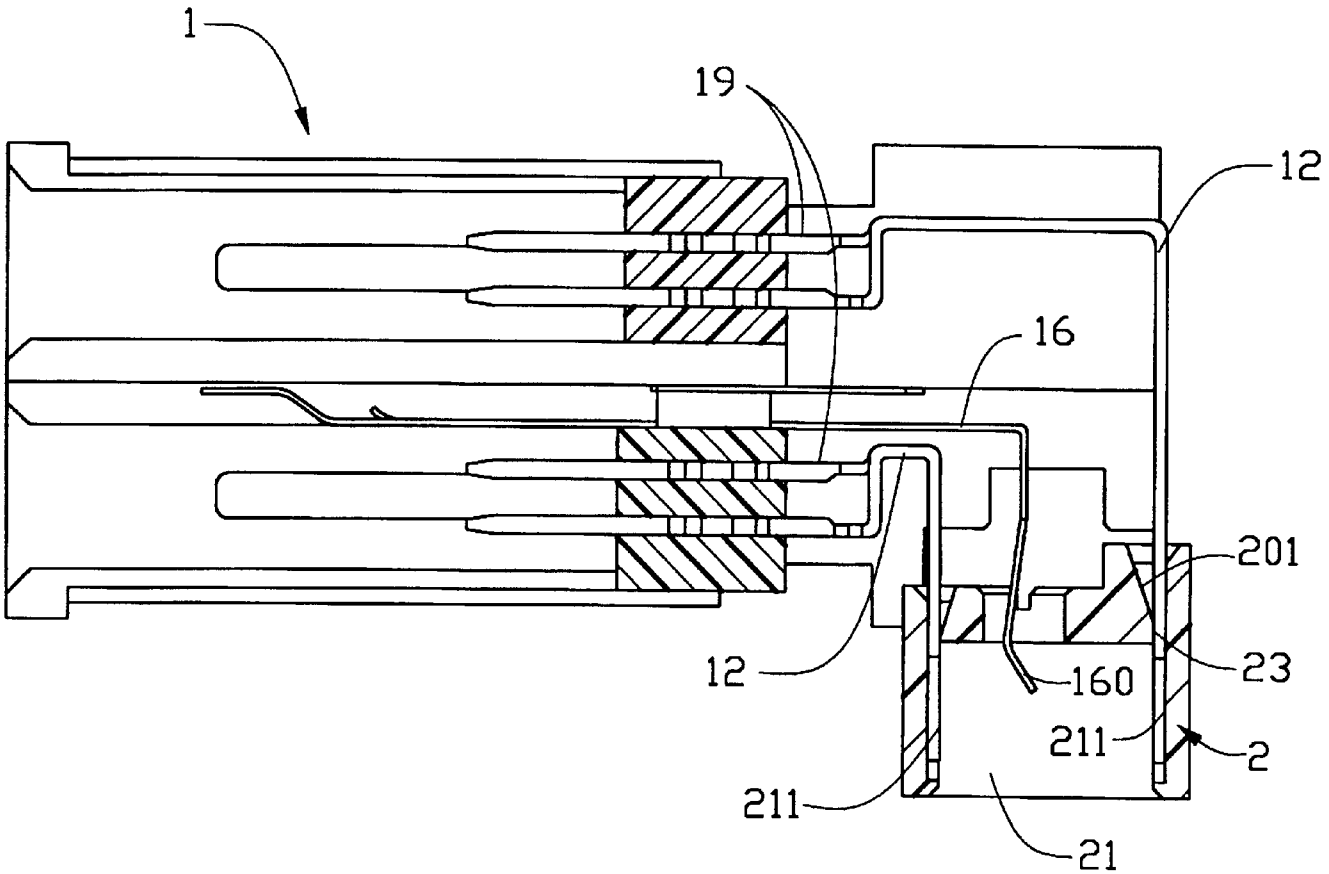

Referring to FIGS. 3, 4 and 5, the mounting portion 12 of each terminal 19 extends into the corresponding tunnel 20 and is deflected by the inclined surface 201. The projecting area 23 outwardly deflects the mounting portions 12 to closely abut against the inner surfaces 21 1 of the tunnel 20. The fingers 160 of the grounding plate 16 extend through the opening 22 and into the cavity 21 to be disposed between the two rows of the mounting portions 12 thereby preventing cross talk from occurring therebetween.

Figure 6:
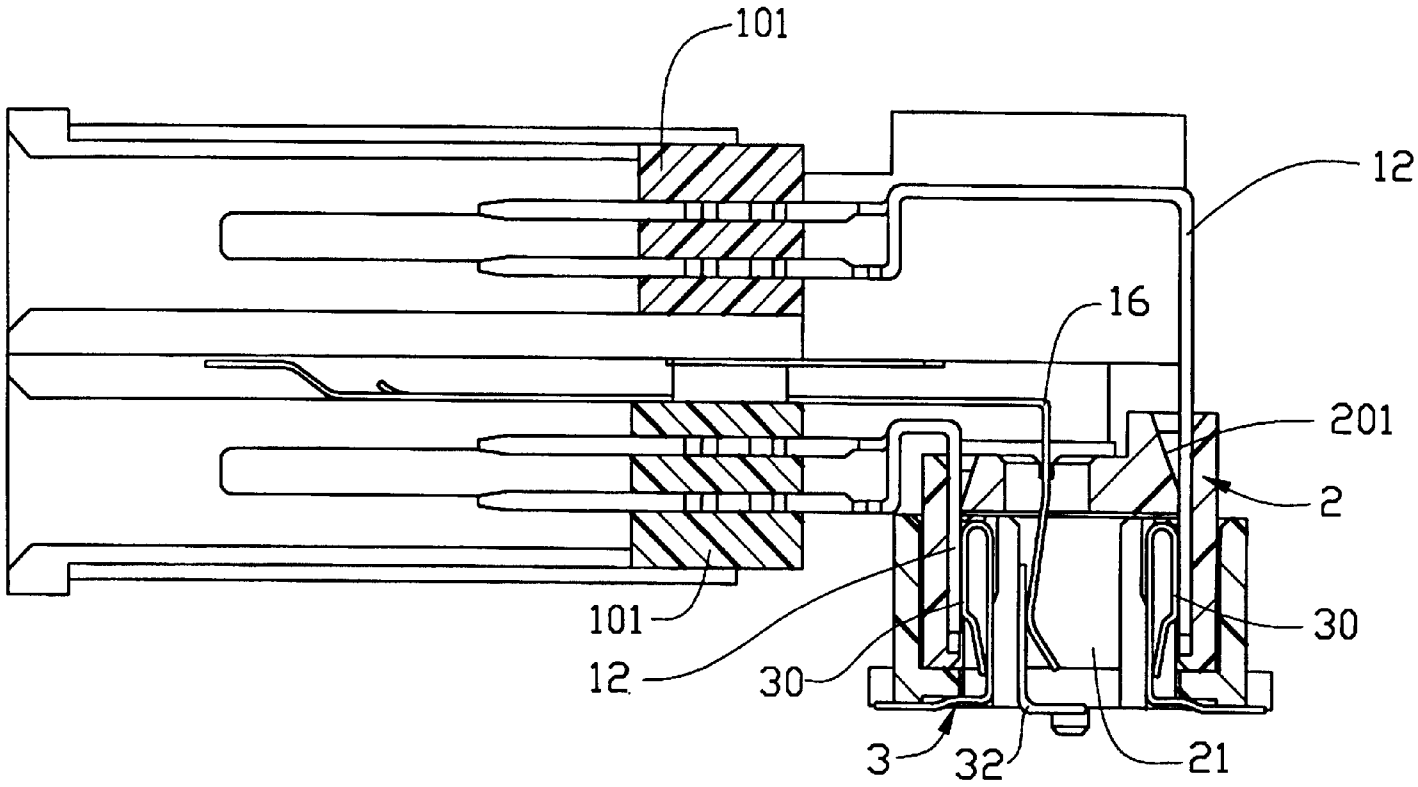
FIG. 6 is a partial, cross-sectional view of the IC card connector engaging with a plug.

Also referring to FIG. 6, a plug 3 mounted on the mother board (not shown) comprises two rows of contacts 30 retained in opposite sides thereof and a metal plate 32 disposed between the two rows of the contacts 30. Each contact 30 has a reversely bent contact section (not labeled). The contacts 30 and the metal plate 32 are soldered to the mother board using Surface Mounting Technology. In assembly, the locator 2 mates with the plug 3. Since the mounting portions 12 are deflected by the projection areas 23 to closely abut against the inner surfaces 211 of the tunnels 20, the contact sections reliably engage with the mounting portions 12 thereby ensuring high quality signal transmission between the IC card connector assembly 1 and the plug 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An IC card connector assembly comprising:

a header connector including an insulative housing and a plurality of terminals retained in the housing, each terminal having a mating portion on one end and a mounting portion on the other end, the mounting portions extending out of the housing;

a locator including a pair of side walls and a center portion between the side walls, the locator having an upper surface and a lower surface opposite the upper surface, the locator defining a plurality of tunnels exposed at the upper surface and a cavity exposed at the lower surface, the cavity being defined by the center portion and the side walls, each tunnel being located proximate the side wall for receiving the mounting portion;

a projecting area formed at the center portion and exposed to each tunnel for biasing the mounting portion toward the side wall;

wherein the terminals are arranged in two rows extending out of the housing, wherein the tunnels are arranged in two rows, and wherein the mounting portions are also arranged in two rows, the distance between the two rows of the tunnels being slightly larger than the distance between the two rows of the mounting portions.

2. The IC card connector assembly as claimed in claim 1, wherein an inclined surface is formed in an edge of the center portion between the projecting area and the upper surface of the locator for properly guiding the insertion of the mounting portion into the tunnel.

3. The IC card connector assembly as claimed in claim 1, wherein there are two stacked header connectors.

4. The IC card connector assembly as claimed in claim 3, wherein the stacked header connectors together have two rows of mounting portions and the locator defines two rows of tunnels for receiving the two mounting portions.

5. The IC card connector assembly as claimed in claim 4, wherein a grounding plate is disposed between the header connectors for shielding the terminals against external interference.

6. The IC card connector assembly as claimed in claim 5, wherein the locator defines an opening between the two rows of the tunnels, and wherein the grounding plate forms a plurality of fingers downwardly extending through the opening into the cavity.

7. The IC card connector assembly as claimed in claim 1, wherein the mounting portions are substantially perpendicular to the mating portions of the terminals.

* * * * *